US007910274B2

(12) United States Patent
Tanaka et al.

(10) Patent No.: US 7,910,274 B2
(45) Date of Patent: Mar. 22, 2011

(54) ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

(75) Inventors: Masato Tanaka, Tagata-gun (JP); Takehiko Endo, Matsudo (JP); Atsushi Fujii, Yokohama (JP); Kenichi Kaku, Suntou-gun (JP); Yuka Ishiduka, Suntou-gun (JP); Masaki Nonaka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 5 days.

(21) Appl. No.: 12/430,422

(22) Filed: Apr. 27, 2009

(65) Prior Publication Data

US 2009/0208247 A1 Aug. 20, 2009

Related U.S. Application Data

(63) Continuation of application No. PCT/JP2008/072211, filed on Dec. 1, 2008.

(30) Foreign Application Priority Data

Dec. 4, 2007 (JP) ..... 2007-313574

(51) Int. Cl.
*G03G 5/00* (2006.01)

(52) U.S. Cl. ..... 430/60; 430/64; 430/65; 399/159; 399/111

(58) Field of Classification Search ..... 430/60, 430/64, 65; 399/159, 111
See application file for complete search history.

(56) References Cited

U.S. PATENT DOCUMENTS

| | | | | |
|---|---|---|---|---|
| 5,013,624 | A | 5/1991 | Yu | 430/60 |
| 5,464,718 | A | 11/1995 | Kashizaki et al. | 430/58 |
| 5,744,271 | A | 4/1998 | Aizawa et al. | 430/58 |
| 5,789,127 | A | 8/1998 | Yamaguchi et al. | 430/64 |
| 6,143,453 | A | 11/2000 | Sugimura et al. | 430/65 |
| 6,737,145 | B1 * | 5/2004 | Watanabe et al. | 428/64.4 |
| 2001/0006757 | A1 | 7/2001 | Fukino et al. | 430/270.1 |
| 2007/0059618 | A1 | 3/2007 | Kurimoto et al. | 430/58.5 |
| 2007/0077507 | A1 | 4/2007 | Otsubo et al. | 430/60 |

FOREIGN PATENT DOCUMENTS

| | | |
|---|---|---|
| JP | 58-093062 | 6/1983 |
| JP | 59-084257 | 5/1984 |
| JP | 03-191361 | 8/1991 |

(Continued)

OTHER PUBLICATIONS

International Search Report (PCT/JP2008/072211) 2 pages.

(Continued)

*Primary Examiner* — Mark A Chapman
(74) *Attorney, Agent, or Firm* — Fitzpatrick, Cella, Harper & Scinto

(57) ABSTRACT

An electrophotographic photosensitive member is provided in which both a potential variation over a long time period and a potential variation within a short time period are suppressed. A method of producing the electrophotographic photosensitive member, and a process cartridge and an electrophotographic apparatus each having the electrophotographic photosensitive member are also provided. In the electrophotographic photosensitive member, an intermediate layer is a layer formed by coating and drying a coating liquid for an intermediate layer, containing an acidic titania sol and an organic resin, and the acidic titania sol is an acidic sol containing anatase-type titanium oxide crystal particles having an average primary particle diameter of 3 nm or more and 9 nm or less.

17 Claims, 1 Drawing Sheet

FOREIGN PATENT DOCUMENTS

| | | |
|---|---|---|
| JP | 08-087124 | 4/1996 |
| JP | 08-220790 | 8/1996 |
| JP | 2000-047415 | 2/2000 |
| JP | 2000-137320 | 5/2000 |
| JP | 2002-351107 | 12/2002 |
| JP | 2005-134924 | 5/2005 |
| JP | 2005-221923 | 8/2005 |
| JP | 2005-266047 | 9/2005 |
| JP | 2007-108659 | 4/2007 |
| JP | 2007-148357 | 6/2007 |
| JP | 2007-188042 | 7/2007 |
| JP | 2008-129218 | 6/2008 |

OTHER PUBLICATIONS

International Preliminary Report on Patentability, 10 pages, Jun. 17, 2010.

* cited by examiner

ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

CROSS-REFERENCE TO RELATED APPLICATIONS

This application is a continuation of International Application No. PCT/JP2008/072211, filed Dec. 1, 2008, which claims the benefit of Japanese Patent Applications No. 2007-313574, filed Dec. 4, 2007.

BACKGROUND OF THE INVENTION

1. Field of the Invention

The present invention relates to an electrophotographic photosensitive member, a method of producing an electrophotographic photosensitive member, a process cartridge, and an electrophotographic apparatus.

2. Description of the Related Art

An electrophotographic photosensitive member using an organic photoconductive substance (organic electrophotographic photosensitive member) has the following advantages: the organic electrophotographic photosensitive member can be easily produced as compared with an electrophotographic photosensitive member using an inorganic photoconductive substance (inorganic electrophotographic photosensitive member), and has a higher degree of freedom in functional design than the inorganic electrophotographic photosensitive member because a material for the organic electrophotographic photosensitive member can be selected from a wide variety of materials. With the advent of rapid widespread of laser beam printers in recent years, such organic electrophotographic photosensitive member has come to be widely used in the market.

A general electrophotographic photosensitive member has a support and a photosensitive layer formed on the support. In addition, a laminated photosensitive layer obtained by superimposing in this order from the support side a charge-generating layer containing a charge-generating substance and a hole-transporting layer containing a hole-transporting substance has been often used as the photosensitive layer.

In addition, an intermediate layer is often provided between the support and the photosensitive layer for the purpose of, for example, improving adhesiveness between the support and the photosensitive layer, protecting the photosensitive layer from electrical breakdown, or inhibiting holes from being injected from the support into the photosensitive layer.

Although such an intermediate layer has the above-mentioned merit, the intermediate layer involves the following demerit: charge is apt to accumulate in the intermediate layer. When image formation is repeatedly performed for a long time period, the accumulation of charge in the intermediate layer has increased a potential variation to cause problems in an output image in some cases.

Japanese Patent Application Laid-Open No. 2005-134924, Japanese Patent Application Laid-Open No. 2005-221923, and Japanese Patent Application Laid-Open No. 2007-148357 each disclose a technique for alleviating a potential variation or suppressing interference fringes by incorporating surface-treated titanium oxide particles each having a small particle diameter into an intermediate layer. However, there is still room for improvement in terms of the potential variation when image formation is repeatedly performed for a long time period.

In addition, Japanese Patent Application Laid-Open No. S58-93062, Japanese Patent Application Laid-Open No. S59-84257, Japanese Patent Application Laid-Open No. H09-90661, and Japanese Patent Application Laid-Open No. 2000-66432 each disclose a technique for reducing a potential variation such as an increase in residual potential or a reduction in initial potential when image formation is repeatedly performed by using an electrophotographic photosensitive member having an intermediate layer. In the existing circumstances, however, demerits such as deterioration in initial sensitivity or deterioration in chargeability are involved, so the problems have not been sufficiently solved yet.

SUMMARY OF THE INVENTION

In association with electrophotographic apparatuses improved for high speed, image quality and full color in recent years, a problem has been raised in that when image formation is repeatedly performed, a potential variation (variation in dark potential (charge potential) or light potential) is suppressed in a higher level. Specific examples of the potential variation include:

(1) a potential variation over a relatively long time period (a time period commencing at the initiation of the use, and ending at the termination of the life, of the electrophotographic photosensitive member); and (2) a potential variation within a relatively short time period (for example, a time period commencing at the initiation of image formation on a first sheet and ending at the completion of continuous image formation on about 1,000 sheets).

Such potential variations has been required to be suppressed at a higher level.

With regard to the above section (1), in general, the longer the time period for which the electrophotographic photosensitive member is used, the larger the deterioration in the potential characteristic of the electrophotographic photosensitive member is. When the electrophotographic photosensitive member which has already been used for a long time period is left to stand, there is a low possibility that the potential characteristic returns to that at the time of the initiation of the use of the electrophotographic photosensitive member. Accordingly, it can be said that the recoverability of the potential variation over a long time period described in the above section (1) is insufficient.

With regard to the above section (2), for example, the electrophotographic photosensitive member rotates several times for forming an image on an A4 size sheet of paper, but the potential characteristic of the electrophotographic photosensitive member fluctuates in the sheet, and hence the tint or density of an output image changes in some cases. In addition, when outputting the same image on multiple sheets, the density of the image may be different between the first sheet and the density of the image on the n-th sheet (where n>1). Such a potential variation within a short time period becomes remarkable when image formation is performed under a low-humidity environment.

Such potential variation characteristic within a short time period is recovered to some extent by leaving the electrophotographic photosensitive member to stand after the use of the electrophotographic photosensitive member.

On the other hand, the potential variation over a long time period described in the above section (1) the recoverability of which is insufficient is supposed to be brought about by gradual accumulation of variations which have not been recovered in the electrophotographic photosensitive member owing to the repetition of such use as described in the above section (2).

The electrophotographic photosensitive member should be able to perform image formation stably at all times by suppressing both the potential variation over a long time period described in the above section (1) and the potential variation within a short time period described in the above section (2).

An object of the present invention is to provide an electrophotographic photosensitive member in which both a potential variation over a long time period and a potential variation within a short time period are suppressed, a method of producing the electrophotographic photosensitive member, and a process cartridge and an electrophotographic apparatus each having the electrophotographic photosensitive member.

That is, the present invention relates to an electrophotographic photosensitive member, including: a support; an intermediate layer formed on the support; a charge-generating layer containing a charge-generating substance, formed on the intermediate layer; and a hole-transporting layer containing a hole-transporting substance, formed on the charge-generating layer, in which: the intermediate layer is a layer formed by coating and drying a coating liquid for an intermediate layer containing an acidic titania sol and an organic resin; and the acidic titania sol includes an acidic sol containing anatase-type titanium oxide crystal particles having an average primary particle diameter of 3 nm or more and 9 nm or less.

In addition, the present invention relates to a method of producing an electrophotographic photosensitive member, including: forming an intermediate layer on a support; forming a charge-generating layer containing a charge-generating substance on the intermediate layer; and forming a hole-transporting layer containing a hole-transporting substance on the charge-generating layer, in which: the formation of the intermediate layer includes formation of the intermediate layer by coating and drying of a coating liquid for an intermediate layer, containing an acidic titania sol and an organic resin; and the acidic titania sol includes an acidic sol containing anatase-type titanium oxide crystal particles having an average primary particle diameter of 3 nm or more and 9 nm or less.

In addition, the present invention relates to a process cartridge which integrally holds the electrophotographic photosensitive member described above and at least one unit selected from the group consisting of a charging unit for charging the surface of the electrophotographic photosensitive member, a developing unit for developing an electrostatic latent image formed on the surface of the electrophotographic photosensitive member with toner to form a toner image on the surface of the electrophotographic photosensitive member, and a cleaning unit for removing the toner remaining on the surface of the electrophotographic photosensitive member after the toner image has been transferred onto a transfer material, and is detachably mountable on a main body of an electrophotographic apparatus.

Further, the present invention relates to an electrophotographic apparatus, including: the electrophotographic photosensitive member described above; a charging unit for charging the surface of the electrophotographic photosensitive member; an exposing unit for irradiating the charged surface of the electrophotographic photosensitive member with exposure light to form an electrostatic latent image on the surface of the electrophotographic photosensitive member; a developing unit for developing the electrostatic latent image formed on the surface of the electrophotographic photosensitive member with toner to form a toner image on the surface of the electrophotographic photosensitive member; and a transferring unit for transferring the toner image formed on the surface of the electrophotographic photosensitive member onto a transfer material.

The present invention can provide an electrophotographic photosensitive member in which both a potential variation within a long time period and a potential variation within a short time period are suppressed, a method of producing the electrophotographic photosensitive member, and a process cartridge and an electrophotographic apparatus each having the electrophotographic photosensitive member.

DESCRIPTION OF THE EMBODIMENTS

Figure 1:
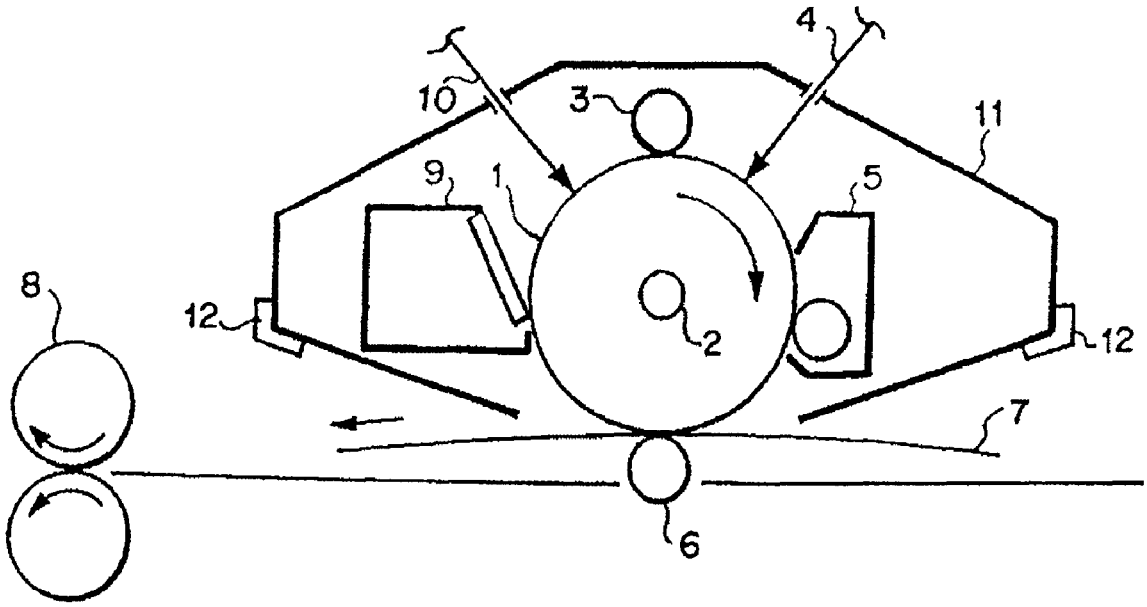
FIG. 1 is a schematic view illustrating the constitution of an electrophotographic apparatus including a process cartridge having an electrophotographic photosensitive member of the present invention.

An electrophotographic photosensitive member of the present invention includes: a support; an intermediate layer formed on the support; a charge-generating layer containing a charge-generating substance, formed on the intermediate layer; and a hole-transporting layer containing a hole-transporting substance, formed on the charge-generating layer.

In addition, the electrophotographic photosensitive member of the present invention is characterized in that: the above intermediate layer is a layer formed by coating and drying a coating liquid for an intermediate layer containing an acidic titania sol and an organic resin; and the above acidic titania sol is an acidic sol containing anatase-type titanium oxide crystal particles having an average primary particle diameter of 3 nm or more and 9 nm or less.

It should be noted that the average primary particle diameter of the titanium oxide crystal particles (particles of a titanium oxide crystal) is referred to also as "average crystallite diameter".

In addition, the titanium oxide crystal particles is hereinafter referred to simply as "titanium oxide particles".

The above acidic titania sol to be used in the present invention can be obtained by, for example, the following procedure: an aqueous solution of titanyl sulfate is hydrolyzed by heating or the like, the precipitated water-containing titanium oxide is neutralized, filtrated, and washed with water, and the resultant cake is peptized with a strong acid such as hydrochloric acid or nitric acid.

The above acidic titania sol to be used in the present invention is hereinafter referred to also as "acidic titania sol according to the present invention".

In ordinary cases, the titania sol shows acid, neutral, or basic depending on the kind of, for example, acid or base, or a stabilizer to be used at the time of the production of the sol.

The titania sol is suitably an acidic sol (acidic titania sol) containing anatase-type titanium oxide crystal particles having an average primary particle diameter of 3 nm or more and 9 nm or less in order that the potential variations may be suppressed while the chargeability of the electrophotographic photosensitive member is maintained. The average primary particle diameter of the anatase-type titanium oxide crystal particles is more suitably 5 nm or more and 7 nm or less.

Although the acidic component of the acidic titania sol according to the present invention may be an arbitrary one such as a mineral acid or an organic acid, the acidic titania sol is preferably a hydrochloric acid sol or a nitric acid sol from the viewpoint of the suppression of the potential variations.

Suitable examples of the acidic titania sol according to the present invention are shown below. However, the present invention is not limited to these examples.

Trade Name: TKS-201 (a hydrochloric acid sol, containing 33 mass % of anatase-type titanium oxide crystal particles having an average primary particle diameter of 6 nm, manufactured by Tayca Co., Ltd.)

Trade Name: TKS-202 (a nitric acid sol containing 33 mass % of anatase-type titanium oxide crystal particles having an average primary particle diameter of 6 nm, manufactured by Tayca Co., Ltd.)

Trade Name: STS-01 (a nitric acid sol containing 30 mass % of anatase-type titanium oxide crystal particles having an average primary particle diameter of 7 nm, manufactured by Ishihara Sangyo Kaisha Ltd.)

Trade Name: STS-02 (a hydrochloric acid sol, containing 30 mass % of anatase-type titanium oxide crystal particles having an average primary particle diameter of 7 nm, manufactured by Ishihara Sangyo Kaisha Ltd.)

Trade Name: STS-100 (a nitric acid sol containing 20 mass % of anatase-type titanium oxide crystal particles having an average primary particle diameter of 5 nm, manufactured by Ishihara Sangyo Kaisha Ltd.)

The average primary particle diameter (average crystallite diameter) of the titanium oxide crystal particles in the acidic titania sol according to the present invention can be measured and calculated by the following method.

The half width $\beta$ (radian) and peak position $2\theta$ (radian) of the peak of the strongest interference line of titanium oxide are determined with an X-ray diffracting device. The average primary particle diameter is calculated from Scherrer's equation shown below.

Average primary particle diameter (average crystallite diameter) of titanium oxide crystal particles [nm]$=K\cdot\lambda/(\beta\cos\theta)$ (In the Scherrer equation shown above, K represents a constant, $\lambda$ (nm) represents the wavelength of a measurement X-ray (CuK$\alpha$ ray: 0.154 nm), $\beta$ represents the half width, and $\theta$ represents the angle of incidence of the X-ray.)

The electrophotographic photosensitive member of the present invention can suppress the above potential variation within a short time period because the electrophotographic photosensitive member has an intermediate layer formed by coating and drying a coating liquid for an intermediate layer, containing the acidic titania sol according to the present invention and an organic resin. As a result, a change in tint of an image in one sheet of paper can be suppressed, and upon outputting the same image on multiple sheets, the difference in image density between the first sheet and the n-th sheet (where n>1) can be suppressed. In addition, the above potential variation over a long time period can also be suppressed because deterioration in the potential characteristic of the electrophotographic photosensitive member when the electrophotographic photosensitive member is used for a long time period can be suppressed.

The electrophotographic photosensitive member of the present invention includes: a support, an intermediate layer formed on the support; a charge-generating layer containing a charge-generating substance, formed on the intermediate layer; and a hole-transporting layer containing a hole-transporting substance, formed on the charge-generating layer.

The support has only to have conductivity (has only to be a conductive support), and examples of the support include: a support made of a metal such as aluminum, stainless steel, or nickel; and a support made of a metal, plastic, or paper and having a conductive coating formed on its surface. In addition, the shape of the support is, for example, a cylindrical shape or a film shape. Of these supports, the cylindrical support made of aluminum is preferable in terms of a mechanical strength, an electrophotographic characteristic, and cost. Although such supports may be each used without being treated, the untreated pipe may be subjected before use to physical treatment such as cutting or honing, or chemical treatment such as anodization or treatment with acid or the like.

A layer aimed at, for example, covering defects on the surface of the support or preventing interference fringes (referred to as, for example, "conductive layer" or "interference fringe-preventing layer" in some cases) may be provided between the support and the intermediate layer.

Such a conductive layer (interference fringe-preventing layer) can be formed by: dispersing inorganic particles made of, for example, tin oxide, indium oxide, titanium oxide, or barium sulfate in a solvent together with a curable resin such as a phenol resin to prepare a coating liquid; coating the liquid onto the support; and drying the coated liquid.

The conductive layer (interference fringe-preventing layer) preferably has a thickness of 5 μm or more and 30 μm or less.

The intermediate layer is formed on the support or the conductive layer (interference fringe-preventing layer)

As described above, the intermediate layer is formed by: coating the coating liquid for an intermediate layer, containing the acidic titania sol according to the present invention and the organic resin onto the support or the conductive layer (interference fringe-preventing layer); and drying the coated liquid.

Examples of the organic resin (binder resin) to be used in the intermediate layer include a phenol resin, an epoxy resin, polyurethane, polycarbonate, polyarylate, polyester, polyimide, polyamide imide, polyamide acid, polyethylene, polystyrene, a styrene-acrylic copolymer, an acrylic resin, polymethacrylate, polyvinyl alcohol, polyvinyl acetal, polyvinyl butyral, polyvinyl benzal, polyvinyl formal, polyacrylonitrile, polyacrylamide, an acrylonitrile-butadiene copolymer, polyvinylchloride, a vinylchloride-vinyl acetate copolymer, cellulose, a melamine resin, amylose, amylopectin, polysulfone, polyether sulfone, polyamide (such as nylon 6, nylon 66, nylon 610, copolymer nylon, alkoxymethylated nylons, and the like), and a silicone resin. Each of them may be used alone, or two or more of them can be mixed, before they are used. Of those resins, from the viewpoint of coating properties when coating a coating liquid for a charge-generating layer onto an intermediate layer, polyamides are preferably used. Further, of the polyamides, from the viewpoint of controlling a potential variation, alkoxymethylated nylons are preferable, and of those, methoxymethylated nylon 6 is more preferable.

Further, for the purpose of adjusting volume resistivity and dielectric constant, a metal or metal oxide may be included in the intermediate layer. Specific examples include particles of metal such as aluminum and copper and particles of metal oxides such as aluminum oxide, tin oxide, indium oxide, titanium oxide, zirconium oxide, zinc oxide, silicon oxide, tantalum oxide, molybdenum oxide, and tungsten oxide. Further, the intermediate layer may also include organic metal compounds such as zirconium tetra-n-butoxide, titanium tetra-n-butoxide, aluminum isopropoxide, and methylmethoxysilane, carbon black, and the like. In addition, they may be used as a mixture. Of these, surface-untreated titanium oxide particles having an average primary particle diameter of 13 nm or more and 60 nm or less are preferably incorporated into the intermediate layer in terms of the suppression of the potential variations and the inhibition of the injection of a hole into a photosensitive layer. In order that the surface-untreated titanium oxide particles having an average primary particle diameter of 13 nm or more and 60 nm or less may be incorporated into the intermediate layer, the surface-untreated titanium oxide particles have only to be incorporated into the coating liquid for an intermediate layer together with the acidic titania sol according to the present invention and the organic resin. When the average primary particle diameter of the surface-untreated titanium oxide particles is excessively small, the stability of the coating liquid for an intermediate layer is lowered in some cases. When the average primary particle diameter is excessively large, coating properties at the time of coating a coating liquid for a charge-generating layer onto the intermediate layer deteriorates in some cases. It should be noted that the term "surface-untreated titanium oxide particles" refers to titanium oxide particles the surfaces of which are not coated with an inorganic material or an organic material.

Suitable examples of the surface-untreated titanium oxide particles having an average primary particle diameter of 13 nm or more and 60 nm or less are shown below. However, the present invention is not limited to these examples.

Trade Name: AMT-600 (anatase-type titanium oxide crystal particles (titanium oxide content: 98 mass %) having an average primary particle diameter of 30 nm, manufactured by Tayca Co., Ltd.)

Trade Name: TKP-102 (anatase-type titanium oxide crystal particles (titanium oxide content: 96 mass %) having an average primary particle diameter of 15 nm, manufactured by Tayca Co., Ltd.)

Trade Name: MT-150A (rutile-type titanium oxide crystal particles having an average primary particle diameter of 15 nm, manufactured by Tayca Co., Ltd.)

Trade Name: MT-500B (rutile-type titanium oxide crystal particles (titanium oxide content: 98 mass %) having an average primary particle diameter of 35 nm, manufactured by Tayca Co., Ltd.)

Trade Name: MT-600B (rutile-type titanium oxide crystal particles having an average primary particle diameter of 50 nm, manufactured by Tayca Co., Ltd.)

In addition, the surface-untreated titanium oxide particles having an average primary particle diameter of 13 nm or more and 60 nm or less are more preferably rutile-type titanium oxide crystal particles in terms of the suppression of the potential variation over a long time period.

In addition, an azo pigment may be incorporated into the intermediate layer for suppressing the potential variation within a short time period. Examples of the azo pigment include a monoazo pigment, a bisazo pigment, a trisazo pigment, and a tetrakisazo pigment. Although the azo pigment to be incorporated into the intermediate layer may be one that can be used as a charge-generating substance, the azo pigment is not requested to have substantial sensitivity when the azo pigment is incorporated into the intermediate layer as in the present invention.

Of the azo pigments, an azo pigment including a coupler structure represented by the following general formula (1) is preferable because the azo pigment exhibits good dispersion stability in the coating liquid for an intermediate layer containing the acidic titania sol according to the present invention and the organic resin, and significantly contributes to the suppression of the potential variations.

(1)

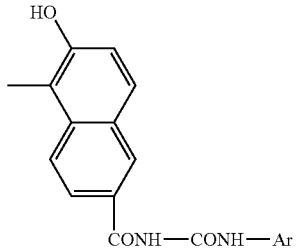

(In the formula (1), Ar represents a substituted or unsubstituted aryl group.)

Of the azo pigments including a coupler structure represented by the above general formula (1), an azo pigment represented by the following general formula (2) is more preferable in terms of dispersion stability in the coating liquid for an intermediate layer, containing the acidic titania sol according to the present invention and the organic resin, and the suppression of the potential variations.

(2)

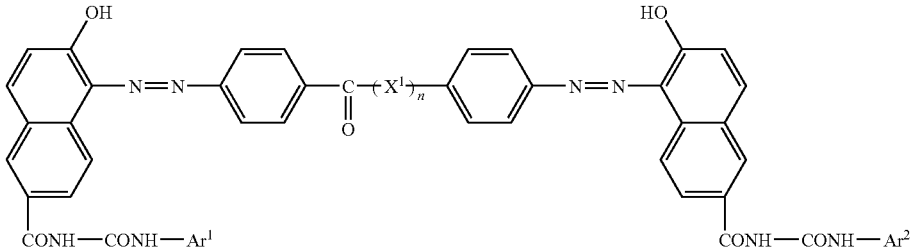

(in the formula (2), $Ar^1$ and $Ar^2$ each independently represent a substituted or unsubstituted aryl group, $X^1$ represents a vinyl group or a p-phenylene group, and n represents an integer of 0 or 1.)

In the above formulae (1) and (2), examples of the aryl group includes, a phenyl group and a naphthyl group. Examples of substituents the aryl group may have include an alkyl group, an aryl groups, an alkoxy group, a dialkylamino group, an arylamino group, a halogen atom, a halomethyl group, a hydroxy group, a nitro group, a cyano group, an acetyl group, and a benzoyl group. Examples of the alkyl group include a methyl group, an ethyl group, a propyl group, and a butyl group. Examples of the aryl group include a phenyl group, a biphenyl group, and a naphthyl group. Examples of the alkoxy group include a methoxy group, a trifluoromethoxy group, and an ethoxy group. Examples of the dialkylamino group include a dimethylamino group and a diethylamino group. Examples of the arylamino group include a phenylamino group, and a diphenylamino group. Examples of the halogen atom include a fluorine atom, a chlorine atom, and a bromine atom. Examples of the halomethyl group include a trifluoromethyl group and a tribromomethyl group. Of these groups, the fluorine atom, the chlorine atom, the bromine atom, the trifluoromethyl group, the trifluoromethoxy group, and the nitro group are preferable.

Suitable examples of the azo pigment represented by the above general formula (2) are shown below. However, the present invention is not limited to these examples.

Exemplified Compound (2-1)

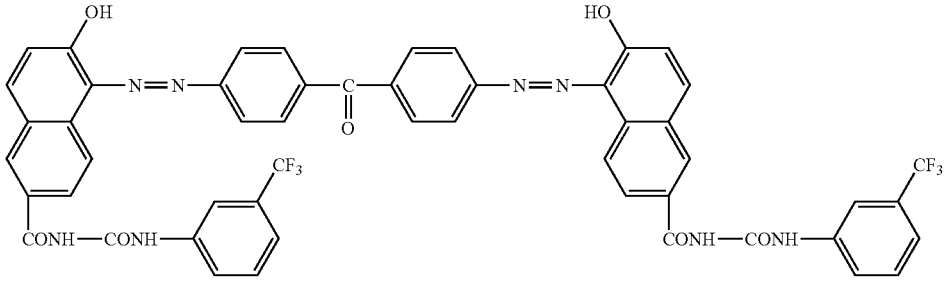

Exemplified Compound (2-2)

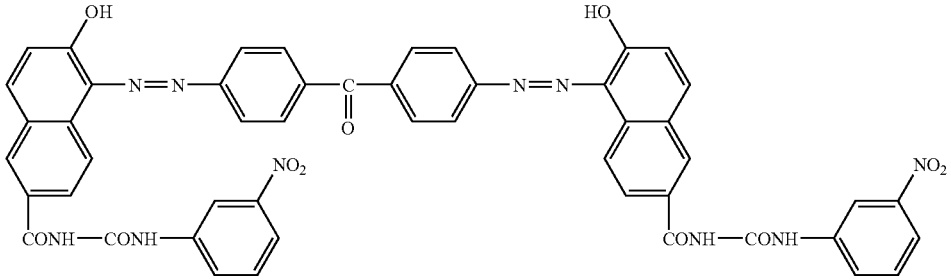

Exemplified Compound (2-3)

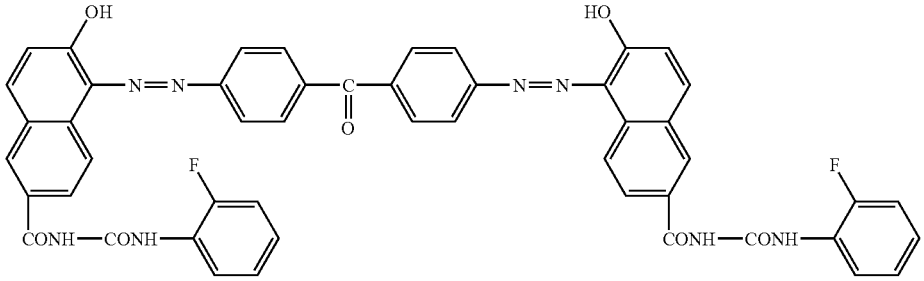

Exemplified Compound (2-4)

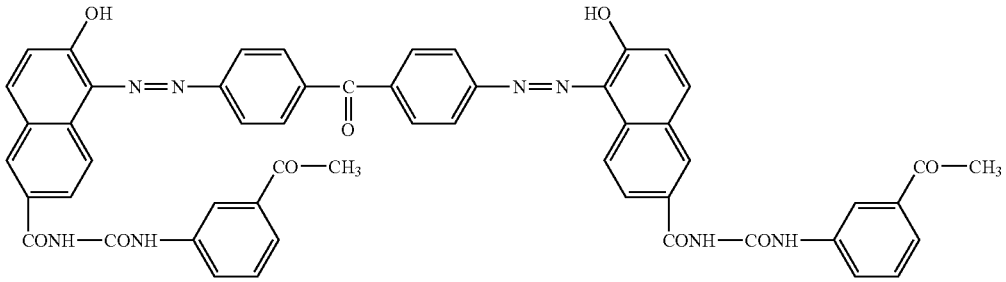

Exemplified Compound (2-5)

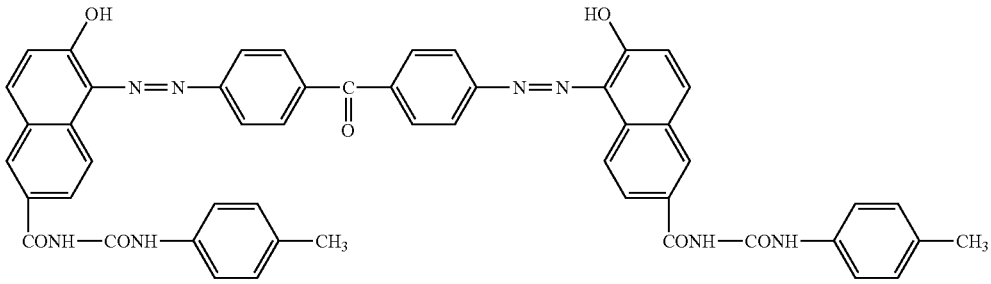

-continued
Exemplified Compound (2-6)
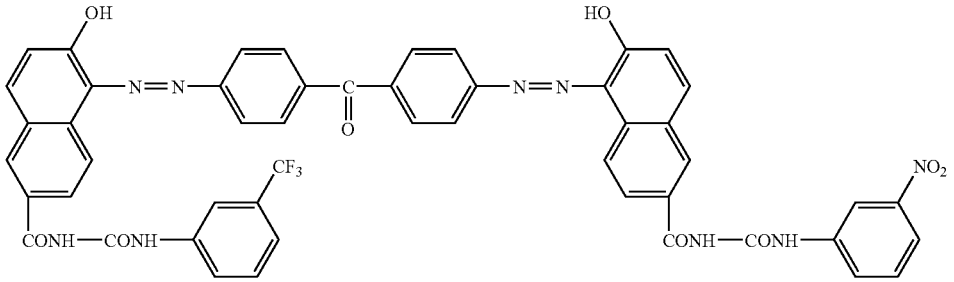
Exemplified Compound (2-7)
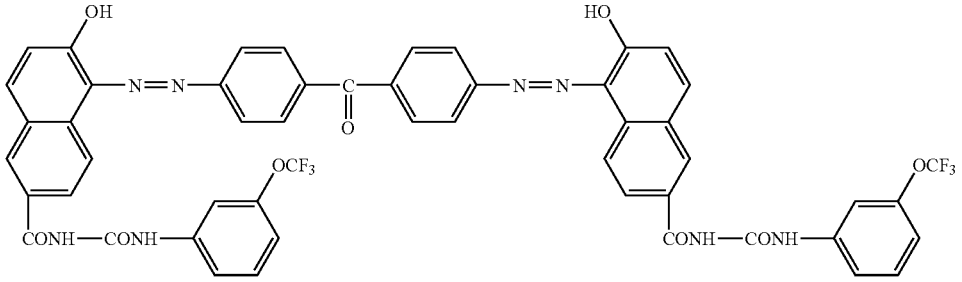
Exemplified Compound (2-8)
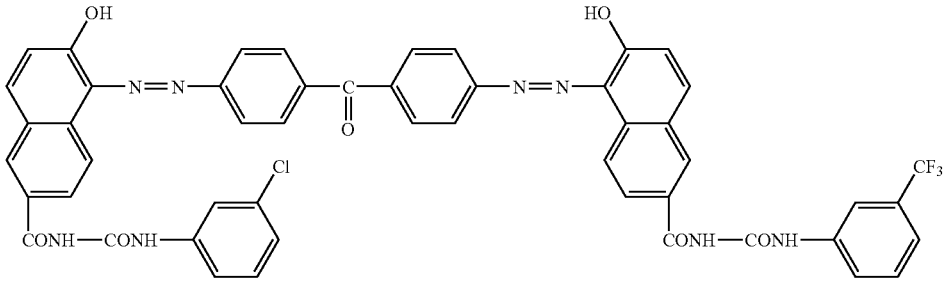
Exemplified Compound (2-9)
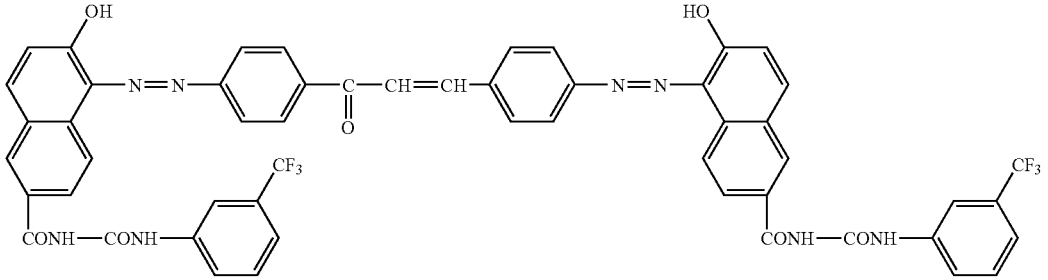
Exemplified Compound (2-10)
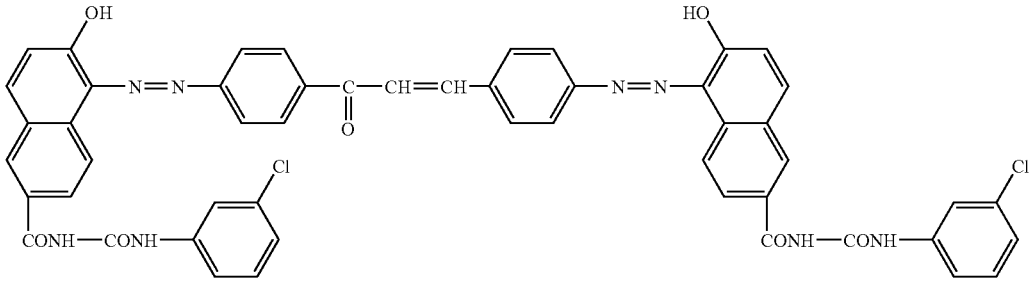

-continued

Exemplified Compound (2-11)

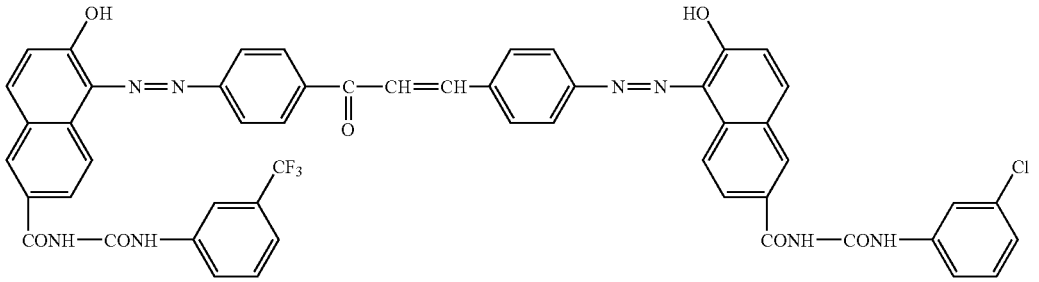

Exemplified Compound (2-12)

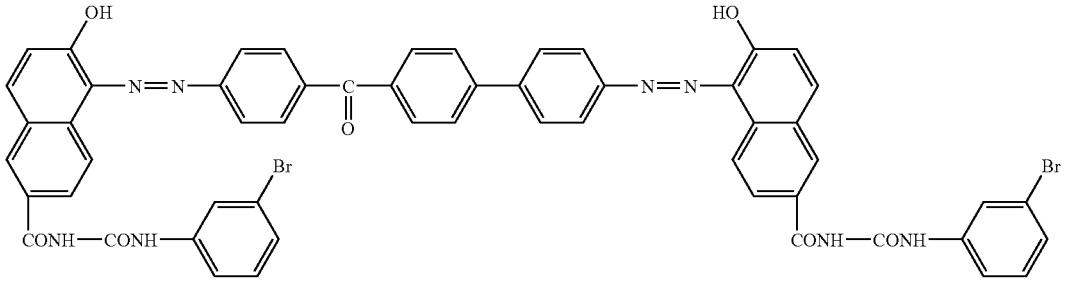

Exemplified Compound (2-13)

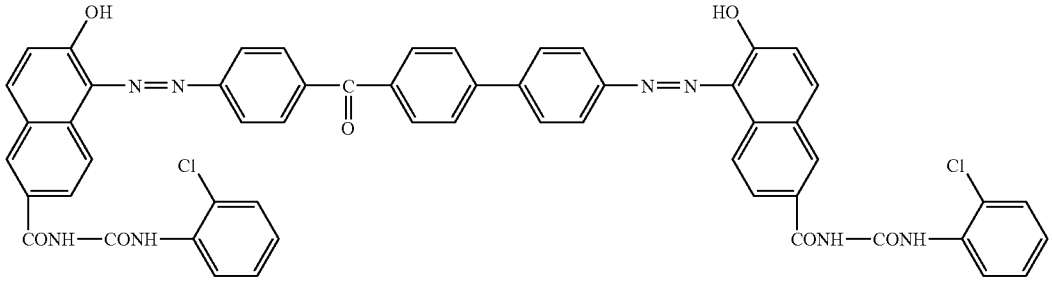

Exemplified Compound (2-14)

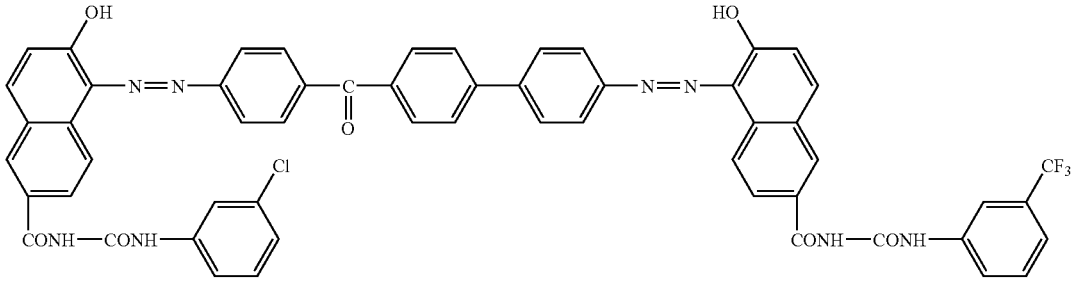

The azo pigment represented by the above general formula (2) can be synthesized in accordance with a general production method for an azo pigment as described in, for example, Japanese Patent Application Laid-Open No. 8-87124.

The content of the anatase-type titanium oxide crystal particles having an average primary particle diameter of 3 nm or more and 9 nm or less in the acidic titania sol according to the present invention in the coating liquid for an intermediate layer is preferably 0.5 mass % or more and 20 mass % or less, or more preferably 1.0 mass % or more and 10 mass % or less, with respect to the total mass of the dry solid in the coating liquid for an intermediate layer. When the content of the anatase-type titanium oxide crystal particles is excessively small, the effect of suppressing the potential variations may be poor. When the content is excessively large, the stability of the coating liquid for an intermediate layer or coating properties at the time of coating the coating liquid for an intermediate layer may be lowered.

In addition, the content of the anatase-type titanium oxide crystal particles having an average primary particle diameter of 3 nm or more and 9 nm or less in the intermediate layer is preferably 0.5 mass % or more and 20 mass % or less, or more preferably 1.0 mass % or more and 10 mass % or less, with respect to the total mass of the intermediate layer. When the content of the anatase-type titanium oxide crystal particles is excessively small, the effect of suppressing the potential variations may be poor.

In addition, when the surface-untreated titanium oxide particles having an average primary particle diameter of 13 nm or more and 60 nm or less are incorporated into the intermediate layer, the content of the surface-untreated titanium oxide particles in the intermediate layer is preferably 20 mass % or more and 60 mass % or less, or more preferably 30 mass % or more and 50 mass % or less, with respect to the total mass of the intermediate layer.

In addition, when the azo pigment is incorporated into the intermediate layer, the content of the azo pigment in the intermediate layer is preferably 5.0 mass % or more and 30 mass % or less, or more preferably 15 mass % or more and 25 mass % or less, with respect to the total mass of the intermediate layer.

The coating liquid for an intermediate layer, containing the acidic titania sol according to the present invention and the organic resin can be prepared by dissolving or dispersing the acidic titania sol according to the present invention and the organic resin in a solvent.

Examples of the solvent to be used in the coating liquid for an intermediate layer include methylal, tetrahydrofuran, methanol, ethanol, isopropyl alcohol, butyl alcohol, methyl cellosolve, and methoxy propanol. One of those solvents may be used alone, or two or more of them may be used as a mixture; two or more of them are preferably used as a mixture in terms of coating properties at the time of coating the coating liquid for an intermediate layer. When methoxymethylated nylon 6 is used as the above organic resin, a mixed solvent of methanol and butanol, or a mixed solvent of ethanol and butanol is preferable in terms of the stability of the coating liquid for an intermediate layer and coating properties at the time of coating the coating liquid for an intermediate layer.

A drying method for drying the coating liquid for an intermediate layer after the coating of the liquid is, for example, drying by heating or drying by blowing. In addition, the drying temperature is preferably 50° C. or higher and 160° C. or lower, or more preferably 140° C. or higher and 155° C. or lower in terms of coating properties at the time of coating the coating liquid for a charge-generating layer onto the intermediate layer and the suppression of the potential variations.

The intermediate layer has a thickness of preferably 0.1 μm or more and 5.0 μm or less, more preferably 0.3 μm or more and 1.5 μm or less, or still more preferably 0.5 μm or more and 1.0 μm or less in terms of the suppression of the potential variations and the inhibition of the injection of a hole into the photosensitive layer.

The charge-generating layer containing the charge-generating substance is formed on the intermediate layer.

The charge-generating layer can be formed by: dissolving or dispersing the charge-generating substance in a solvent together with a binder resin to prepare the coating liquid for a charge-generating layer; coating the liquid onto the intermediate layer; and drying the coated liquid.

Examples of the solvent used as the coating liquid for a charge-generating layer include ethers, ketones, esters, and aromatic compounds. Examples of the ethers include tetrahydrofuran and 1,4-dioxane. Examples of the ketones include cyclohexane, -4-methoxy-4-methyl-2-pentanone, and methylethylketone. Examples of the esters include ethyl acetate and butyl acetate. Examples of the aromatic compounds include toluene, xylene, and monochlorobenzene.

Examples of the binder resin used in the charge-generating layer include a phenol resin, an epoxy resin, polyurethane, polycarbonate, polyarylate, polyester, polyamide imide, polyimide, polyamide acid, polyethylene, polystyrene, a styrene-acrylic copolymer, an acrylic resin, polymethacrylate, polyvinyl alcohol, polyvinyl acetal, polyvinyl butyral, polyvinyl benzal, polyvinyl formal, polyacrylonitrile, polyacrylamide, an acrylonitrile-butadiene copolymer, polyvinylchloride, a vinylchloride-vinyl acetate copolymer, cellulose, a melamine resin, amylose, amylopectin, polysulfone, polyether sulfone, a silicone resin, and the like.

Examples of the charge-generating substance include azo pigments and phthalocyanine pigments. Examples of the azo pigments include a monoazo pigment, a bisazo pigment, a triazo pigment, and a tetrakisazo pigment.

Of the azo pigments, a benzanthrone-based azo pigment disclosed in Japanese Patent Application Laid-Open No. 59-31962 or Japanese Patent Application Laid-Open No. 1-183663 is preferable because the pigment has excellent sensitivity. Although the benzanthrone-based azo pigment has the excellent sensitivity, the pigment is apt to cause a potential variation. However, the incorporation of the benzanthrone-based azo pigment as a charge-generating substance into the charge-generating layer formed on the above intermediate layer can suppress the potential variation while maintaining the excellent sensitivity. Accordingly, the benzanthrone-based azo pigment allows the effect of the present invention to be more effectively exhibited, and can be said to be preferable.

Further, examples of the phthalocyanine pigments include non-metallic phthalocyanine and metallic phthalocyanine. The metallic phthalocyanine may include an axial ligand. Further, the phthalocyanine may be substituted.

Of the phthalocyanine pigments, oxytitanium phthalocyanine and gallium phthalocyanine (such as chlorogallium phthalocyanine and hydroxygallium phthalocyanine) are preferable due to their excellent sensitivity. Although the oxytitanium phthalocyanine and gallium phthalocyanine have excellent sensitivity, a potential variation occurs easily. However, the incorporation of the oxytitanium phthalocyanine or the gallium phthalocyanine as a charge-generating substance into the charge-generating layer formed on the above intermediate layer can suppress the potential variation while maintaining the excellent sensitivity. Accordingly, the oxytitanium phthalocyanine or the gallium phthalocyanine allows the effect of the present invention to be more effectively exhibited, and can be said to be preferable.

In addition, a hydroxygallium phthalocyanine crystal of a crystal form having a strong peak at $2\theta \pm 0.2°$ (where $\theta$ represents a Bragg angle in CuKα X-ray diffraction) of each of $7.4° \pm 0.3°$ and $28.2° \pm 0.3°$ out of the gallium phthalocyanines is more preferable. Although the hydroxygallium phthalocyanine crystal has particularly excellent sensitivity, the crystal is apt to cause a potential variation (especially a variation in initial light potential when image formation is performed under a low-humidity environment). However, the incorporation of the hydroxygallium phthalocyanine crystal as a charge-generating substance into the charge-generating layer formed on the above intermediate layer can suppress the potential variation while maintaining the particularly excellent sensitivity. Accordingly, the hydroxygallium phthalocyanine crystal allows the effect of the present invention to be more effectively exhibited, and can be said to be particularly preferable.

It should be noted that X-ray diffraction in the present invention was performed with CuKα rays under the following conditions.

Measuring machine used: an automatic X-ray diffracting device MXP18 manufactured by MAC Science

| | |
|---|---|
| X-ray tube: | Cu |
| Tube voltage: | 50 kV |
| Tube current: | 300 mA |
| Scanning method: | 2θ/θ scan |

-continued

| | |
|---|---|
| Scanning rate: | 2 deg./min |
| Sampling interval: | 0.020 deg. |
| Start angle (2θ): | 5 deg. |
| Stop angle (2θ): | 40 deg. |
| Divergence slit: | 0.5 deg. |
| Scattering slit: | 0.5 deg. |
| Receiving slit: | 0.3 deg. |

A curved monochromator was used.

The charge-generating layer has a thickness of preferably 0.01 μm or more and 10 μm or less, or more preferably 0.05 μm or more and 5 μm or less.

The hole-transporting layer containing the hole-transporting substance is formed on the charge-generating layer.

The hole-transporting layer can be formed by: dissolving the hole-transporting substance in a solvent together with a binder resin to prepare a coating liquid for a hole-transporting layer; coating the liquid onto the charge-generating layer; and drying the coated liquid.

Examples of the solvent used for a coating liquid for a hole-transporting layer include ethers, ketones, esters, and aromatic compounds. Examples of the ethers include tetrahydrofuran and 1,4-dioxane. Examples of the ketones include cyclohexane, 4-methoxy-4-methyl-2-pentanone, and methylethylketone. Examples of the esters include ethyl acetate and butyl acetate. Examples of the aromatic compounds include toluene, xylene, and monochlorobenzene.

Examples of the binder resin used in the hole-transporting layer include a phenol resin, an epoxy resin, polyurethane, polycarbonate, polyarylate, polyester, polyimide, polyamide imide, polyamide acid, polyethylene, polystyrene, a styrene-acrylic copolymer, an acrylic resin, polymethacrylate, polyvinyl alcohol, polyvinyl acetal, polyvinyl butyral, polyvinyl benzal, polyvinyl formal, polyacrylonitrile, polyacrylamide, an acrylonitrile-butadiene copolymer, polyvinylchloride, a vinylchloride-vinyl acetate copolymer, cellulose, a melamine resin, amylose, amylopectin, polysulfone, polyether sulfone, a silicone resin, and the like.

Examples of the hole-transporting material include triarlyamine-based compounds, hydrazone-based compounds, stilbene-based compounds, pyrazoline-based compounds, oxazole-based compounds, triazole-based compounds, triarylmethane-based compounds, enamine-based compounds, butadiene-based compounds, and the like.

The hole-transporting layer has a thickness of preferably 5 μm or more and 40 μm or less, or more preferably 10 μm or more and 30 μm or less.

In addition, a protective layer may be provided on the hole-transporting layer for the purpose of improving, for example, the durability, transferring property, or cleaning property.

The protective layer can be formed by: dissolving a resin in a solvent to prepare a coating liquid for a protective layer; coating the liquid onto the hole-transporting layer; and drying the coated liquid.

Examples of the resins include polyvinyl butyral, polyester, polycarbonate, polyamide, polyimide, polyarylate, polyurethane, a styrene-butadiene copolymer, a styrene-acrylic acid copolymer, a styrene-acrylonitrile copolymer, etc.

Alternatively, the protective layer may be formed by curing a monomer having a charge-transporting ability (hole-transporting ability) or a polymeric charge-transporting substance (hole-transporting substance) by using various crosslinking reactions in order that a charge-transporting ability may be imparted to the protective layer. Examples of the reactions for curing include radical polymerization, ion polymerization, thermal polymerization, photopolymerization, radiation polymerization (electron beam polymerization), a plasma CVD method, and a photo CVD method.

Alternatively, conductive particles, a UV absorber, a wear resistance improver, etc. may be incorporated into the protective layer. Examples of the conductive particles include particles of a metal oxide such as tin oxide. In addition, examples of the wear resistance improver include fluorine atom-containing resin particles, alumina, and silica.

The protective layer has a thickness of preferably 0.5 μm or more and 20 μm or less, or more preferably 1 μm or more and 10 μm or less.

A method of coating the coating liquid for each of those layers is, for example, an immersion coating method (dipping method), a spray coating method, a spinner coating method, a bead coating method, a blade coating method, or a beam coating method.

Next, an electrophotographic apparatus having the electrophotographic photosensitive member of the present invention will be described.

The electrophotographic apparatus of the present invention includes: the above electrophotographic photosensitive member of the present invention; a charging unit for charging the surface of the electrophotographic photosensitive member; an exposing unit for irradiating the charged surface of the electrophotographic photosensitive member with exposure light to form an electrostatic latent image on the surface of the electrophotographic photosensitive member; a developing unit for developing the electrostatic latent image formed on the surface of the electrophotographic photosensitive member with toner to form a toner image on the surface of the electrophotographic photosensitive member; and a transferring unit for transferring the toner image formed on the surface of the electrophotographic photosensitive member onto a transfer material.

FIG. 1 is a schematic view illustrating the constitution of an electrophotographic apparatus including a process cartridge having the electrophotographic photosensitive member of the present invention.

In FIG. 1, a drum-shaped electrophotographic photosensitive member 1 of the present invention is rotated around an axis 2 in the direction indicated by an arrow at a predetermined cycle time (time of rotation for one rotation). During the course of the rotation, the surface of the electrophotographic photosensitive member 1 is charged to a predetermined, positive or negative potential by a charging unit 3. Next, the charged surface receives exposure light 4 emitted from an exposing unit (not shown) such as slit exposure or laser beam scanning exposure. The intensity of the exposure light 4 is modulated correspondingly to the time-series electrical digital image signal of target image information. Thus, an electrostatic latent image corresponding to the target image information is formed on the surface of the electrophotographic photosensitive member 1.

The electrostatic latent image formed on the surface of the electrophotographic photosensitive member 1 is developed (subjected to normal development or reverse development) with toner stored in a developing unit 5, whereby a toner image is formed. The toner image formed on the surface of the electrophotographic photosensitive member 1 is transferred onto a transfer material 7 (such as paper) by a transferring unit 6. When the transfer material 7 is paper, for example, the transfer material is taken from a sheet-feeding portion (not shown) so as to be fed into a space between the electrophotographic photosensitive member 1 and the transferring unit 6 in synchronization with the rotation of the electrophotographic photosensitive member 1. In this case, a voltage of a polarity opposite to the charge of the toner is applied from a power supply (not shown) to the transferring unit 6.

The transfer material 7 onto which the toner image has been transferred is separated from the surface of the electrophotographic photosensitive member 1 so as to be conveyed to a fixing unit 8 where the toner image is subjected to fixing treatment. Thus, the transfer material is discharged (printed out) as an image-formed matter (print or copy) to the outside of the electrophotographic apparatus.

Deposit such as the toner remaining on the surface of the electrophotographic photosensitive member 1 after the transfer of the toner image onto the transfer material 7 (transfer residual toner) is removed by a cleaning unit 9, whereby the surface of the electrophotographic photosensitive member 1 is cleaned.

Recent research on a cleaner-less system has enabled the transfer residual toner to be directly recovered by, for example, the developing unit.

Further, the surface of the electrophotographic photosensitive member 1 is repeatedly used in image formation after having been de-charged by pre-exposure light 10 from a pre-exposing unit (not shown). It should be noted that pre-exposure is not necessarily needed when the charging unit 3 is a contact charging unit using a charging roller or the like.

In the present invention, for example, the electrophotographic photosensitive member 1 may be held integrally with at least one unit selected from the group consisting of the charging unit 3, the developing unit 5, and the cleaning unit 9, to form a process cartridge 11 which is detachably mountable on the main body of the electrophotographic apparatus with the aid of a guiding unit 12 (such as a rail) of the main body.

In addition, the exposure light 4 may be reflected light or transmitted light from an original when the electrophotographic apparatus is a copying machine or a printer. Alternatively, the exposure light may be light applied according to, for example, scanning with laser beam performed in accordance with a signal into which an original read by a sensor is converted, the driving of an LED array, or the driving of a liquid crystal shutter array.

In addition, laser light having an oscillatory wavelength of 380 to 450 nm may also be preferably used as the exposure light because the electrophotographic photosensitive member of the present invention can keep a potential variation at the time of image formation extremely small. The use of an exposing unit using such short-wavelength laser together with the above electrophotographic photosensitive member of the present invention enables high-resolution images to be stably formed over a long time period.

In addition, there is such a tendency that the higher the process speed of an electrophotographic process or the smaller the diameter of the electrophotographic photosensitive member, the smaller the cycle time (time of rotation for one rotation) of the electrophotographic photosensitive member and the larger a potential variation within a short time period in the electrophotographic photosensitive member. However, the electrophotographic photosensitive member of the present invention can suppress its potential variation even in such cases. In particular, an electrophotographic apparatus having a cycle time of 0.4 sec or less/rotation is under a condition severe in suppressing a potential variation in an electrophotographic photosensitive member, but according to the present invention, even in the case of such an electrophotographic apparatus, a potential variation in an electrophotographic photosensitive member can be sufficiently suppressed.

The electrophotographic photosensitive member of the present invention can not only be utilized in a copying machine or laser beam printer but also be widely applicable to the fields of application of electrophotography such as a CRT printer, an LED printer, a FAX machine, a liquid crystal printer, and laser plate making.

EXAMPLES

Hereinafter, the present invention is described in more detail by way of specific examples, provided that the present invention is not limited to these examples. It should be noted that "%" and "part(s)" in the examples refer to "mass%" and "part(s) by mass", respectively. In addition, the thickness of each layer of an electrophotographic photosensitive member was determined with an eddy-current thickness meter (Fischerscope, manufactured by Fischer Instruments K.K.) or from the mass of the layer per unit area in terms of specific gravity.

Example 1

An aluminum cylinder (a drawn tube) having a diameter of 30 mm was used as a support.

Preparation of Coating Liquid for Conductive Layer (Interference Fringe-Preventing Layer)

50 parts of titanium oxide particles coated with tin oxide (trade name: Kronos ECT-62, manufactured by Titan Kogyo, Ltd.), 41.7 parts of a resol-type phenol resin (trade name: PLYOPHEN J-325, manufactured by Dainippon Ink and Chemicals Inc., resin solid content 60%), 20 parts of 1-methoxy-2-propanol, 3.8 parts of silicone resin particles (trade name: TOSPEARL 120, manufactured by Toshiba Silicones), 5 parts of methanol, and 0.002 part of silicone oil (polydimethylsiloxane-polyoxyalkylene copolymer, average molecular weight: 3,000) were placed in a sand mill apparatus using 125 parts of glass beads having an average diameter of 0.8 mm, and were subjected to dispersion treatment at 2,000 rpm for 3 hours.

After the dispersion treatment, the glass beads were separated by mesh filtration, and the separated liquid was diluted with a mixed solvent of 1-methoxy-2-propanol and methanol at a ratio of 1:1 so that a solid content was 55%. Thus, a coating liquid for a conductive layer (interference fringe-preventing layer) was prepared.

Formation of Conductive Layer (Interference Fringe-Preventing Layer) (Conductive Layer-Forming Step)

The above coating liquid for a conductive layer (interference fringe-preventing layer) was coated onto the above aluminum cylinder by dip coating, and the coated liquid was dried for 30 minutes at 140° C., whereby a conductive layer (interference fringe-preventing layer) having a thickness of 15 μm was formed.

It should be noted that a sand mill apparatus satisfying the following conditions was used in the preparation of the coating liquid for a conductive layer (interference fringe-preventing layer) and in the preparation of a coating liquid for an intermediate layer and a coating liquid for a charge-generating layer described later.

A batch-type vertical apparatus having a 900 ml-scale vessel volume

The number of disks: five

Coolant temperature: 18° C.

Preparation of Coating Liquid for Intermediate Layer 25 parts of N-methoxymethylated nylon 6 (trade name: Toresin EF-30T, manufactured by Nagase ChemteX Corporation, methoxymethylation ratio: 36.8%) were dissolved in 225 parts of n-butanol (dissolution by heating at 50° C.). After the dissolution, the solution was cooled and filtrated with a membrane filter (trade name: FP-022, pore size: 0.22 μm, manufactured by Sumitomo Electric Industries, Ltd.). Next, 2.4 parts of an acidic titania sol (acidic sol) containing anatase-type titanium oxide crystal particles having an average primary particle diameter of 6 nm (trade name: TKS-201, hydrochloric acid sol, titanium oxide content: 33 mass %, manufactured by TAYCA) were added to the filtrate. The mixture was loaded into a sand mill apparatus using 500 parts of glass beads having an average diameter of 0.8 mm, and was subjected to dispersion treatment at 1,500 rpm for 2 hours.

After the dispersion treatment, the glass beads were separated by mesh filtration, and the separated liquid was diluted with methanol and n-butanol so that a solid content was 3.0% and a solvent ratio between methanol and n-butanol was 2:1. Thus, a coating liquid for an intermediate layer was prepared.

The content of anatase-type titanium oxide crystal particles having an average primary particle diameter of 3 nm or more and 9 nm or less in the acidic titania sol in the coating liquid for an intermediate layer was 3.1 mass % with respect to the total mass of the dry solid matter in the coating liquid for an intermediate layer.

Formation of Intermediate Layer (Intermediate Layer-Forming Step)

The above coating liquid for an intermediate layer was coated onto the above conductive layer (interference fringe-preventing layer) by dip coating, and the coated liquid was dried for 10 minutes at 100° C., whereby an intermediate layer having a thickness of 0.45 μm was formed.

Preparation of Coating Liquid for Charge-Generating Layer 21 parts of a hydroxygallium phthalocyanine crystal (charge-generating substance) of a crystal form having a strong peak at 2θ±0.2° (where θ represented a Bragg angle in CuKα X-ray diffraction) of each of 7.5° and 28.3°, and polyvinyl butyral (trade name: S-LEC BX-1, manufactured by SEKISUI CHEMICAL CO., LTD.) were dissolved in cyclohexanone, whereby a resin solution having a resin concentration of 5% was obtained. 210 parts of the resin solution were charged into a sand mill apparatus using 500 parts of glass beads having an average diameter of 0.8 mm, and were subjected to dispersion treatment at 1,500 rpm for 4 hours.

After the dispersion treatment, the resultant was diluted with 350 parts of cyclohexanone and 600 parts of ethyl acetate, and the glass beads were separated by mesh filtration, whereby a coating liquid for a charge-generating layer was prepared.

Formation of Charge-Generating Layer (Charge-Generating Layer-Forming Step)

The above coating liquid for a charge-generating layer was coated onto the above intermediate layer by dip coating, and the coated liquid was dried for 10 minutes at 100° C., whereby a charge-generating layer having a thickness of 0.17 μm was formed.

Preparation of Coating Liquid for Hole-Transporting Layer 5 parts of a compound (hole-transporting substance) represented by the following structural formula (CTM-1), 5 parts of a compound (hole-transporting substance) represented by the following structural formula (CTM-2), and 10 parts of polycarbonate (trade name: Iupilon Z-400, manufactured by Mitsubishi Engineering-Plastics Corporation) were dissolved in 70 parts of monochlorobenzene, whereby a coating liquid for a hole-transporting layer was prepared.

(CTM-1)

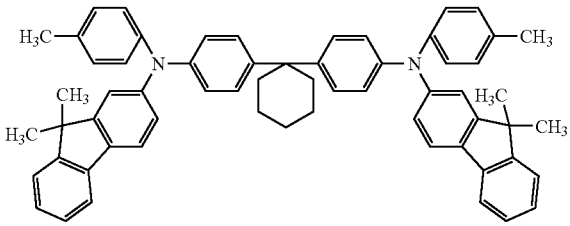

(CTM-2)

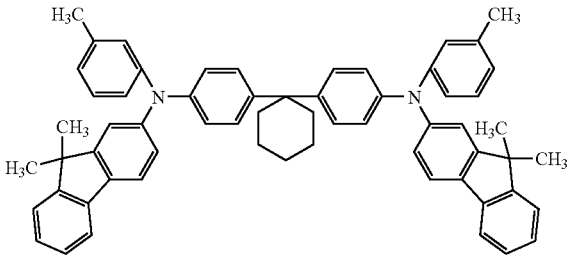

Formation of Hole-Transporting Layer (Hole-Transporting Layer-Forming Step)

The above coating liquid for a hole-transporting layer was coated onto the above charge-generating layer by dip coating, and the coated liquid was dried for 30 minutes at 100° C., whereby a hole-transporting layer having a thickness of 18 μm was formed.

Next, a coating liquid for a protective layer produced in accordance with the following procedure was coated onto the hole-transporting layer to form a protective layer. Thus, the electrophotographic photosensitive member 1 was produced.

Preparation of Coating Liquid for Protective Layer 36 parts of a compound (hole-transporting substance) represented by the following structural formula (CTM-3), 4 parts of polytetrafluoroethylene particles (trade name: LUBRON L-2, manufactured by DAIKIN INDUSTRIES, ltd.), and 60 parts of n-propyl alcohol were mixed, and then was subjected to dispersion treatment with an ultra-high pressure dispersing machine, whereby a coating liquid for a protective layer was prepared.

(CTM-3)

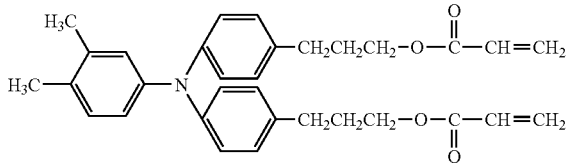

Formation of Protective Layer

The above coating liquid for a protective layer was coated onto the above hole-transporting layer by dip coating, and the coated liquid was dried to the touch. After that, in a nitrogen atmosphere, the resultant was irradiated with electron beams at an accelerating voltage of 60 kV and a dose of 0.8 Mrad. Subsequently, the irradiated body was subjected to heat treatment for 1 minute so that the temperature of the irradiated body was 150° C. In this case, an oxygen concentration in the nitrogen atmosphere was 20 ppm. Further, the resultant was subjected to heat treatment in the air at 120° C. for 1 hour, whereby a protective layer having a thickness of 5 μm was formed.

Thus, the electrophotographic photosensitive member 1 was obtained.

Next, the produced electrophotographic photosensitive member 1 was mounted on a modified apparatus of a copying machine GP-40 (trade name) manufactured by Canon Inc. (the light source was changed to a 0778-nm semiconductor laser the light quantity of which was variable, pre-exposure was changed to a red LED the light quantity of which was variable, and the motor was changed to one whose process speed was variable), and was evaluated for its potential characteristic when repeatedly used.

The potential of the electrophotographic photosensitive member was measured by: removing a developing unit from the main body of the above copying machine; and fixing a probe for potential measurement at a developing position instead of the unit. It should be noted that a transfer unit was out of contact with the electrophotographic photosensitive member, and no paper was passed.

First, the electrophotographic photosensitive member 1 was left to stand under a normal-temperature, low-humidity (23° C./5% RH) environment for 3 days together with the above copying machine. After that, under the same environment, a charging condition and the light quantity of exposure (image exposure) were set so that a dark potential (Vd) was −700 V and a light potential (Vl) was −200 V. In addition, the light quantity of the pre-exposure was three times as large as the light quantity of the LED for attenuating a surface potential from −700 V to −200 V. In addition, a process speed was adjusted to 320 mm/sec (a cycle speed was adjusted to 0.29 sec/rotation).

Next, a Vl durability test involving 5,000 continuous rotations (durability test according to a full-screen black image mode) was performed, and the light potential (Vl) after the 5,000 rotations was measured. As a result, the light potential was −202 V. In this case, the difference (variation) between the initial light potential (Vl) and the light potential (Vl) after the Vl durability test involving 5,000 rotations is defined as ΔVl (initial)=+2 V.

After that, a Vl durability test involving 500,000 rotations was performed. 5 minutes after the completion of the test, the difference (variation, referred to as "ΔVl (after 5 minutes)") between the initial light potential (Vl) and the light potential (Vl) after a Vl durability test involving 5,000 rotations was measured. As a result, ΔVl (after 5 minutes) was +18 V.

The next day (after 24 hours), the difference (variation, referred to as "ΔVl (next day)") between the initial light potential (Vl) and the light potential (Vl) after a Vl durability test involving 5,000 rotations was similarly measured. As a result, ΔVl (next day) was +14 V.

After an additional 1 week, the difference (variation, referred to as "ΔVl (after 1 week)") between the initial light potential (Vl) and the light potential (Vl) after a Vl durability test involving 5,000 rotations was similarly measured. As a result, ΔVl (after 1 week) was +8 V.

In addition, the difference (variation, referred to as "ΔVl (long-term variation)") between the above initial light potential (Vl) after 1 week and the initial light potential (Vl) before a Vl durability test, which was considered to be a potential variation over a long time period the recoverability of which was insufficient, was as follows: ΔVl (long-term variation)=+23 V.

All the foregoing series of evaluations was performed under a normal-temperature, low-humidity environment while none of the charging condition, the light quantity of each of the exposure (image exposure) and the pre-exposure and the process speed was changed from the initial setting. In addition, the pre-exposure was turned on even during a Vl durability test.

Table 1 shows the evaluation results.

Comparative Example 1

An electrophotographic photosensitive member C1 was produced in the same manner as in Example 1 except that the preparation of a coating liquid for an intermediate layer in Example 1 was performed as described below. In addition, the electrophotographic photosensitive member C1 was evaluated in the same manner as in Example 1.

Preparation of Coating Liquid for Intermediate Layer 3 parts of N-methoxymethylated nylon 6 (trade name: Toresin EF-30T, manufactured by Nagase ChemteX Corporation, methoxymethylation ratio: 36.8%) were dissolved in a mixed solvent of 65 parts of methanol and 32.5 parts of n-butanol (dissolution by heating at 65° C.). After the dissolution, the solution was cooled and filtrated with a membrane filter (trade name: FP-022, pore size: 0.22 μm, manufactured by Sumitomo Electric Industries, Ltd.), whereby a coating liquid for an intermediate layer was obtained.

Example 2

An electrophotographic photosensitive member 2 was produced in the same manner as in Example 1 except that the preparation of a coating liquid for an intermediate layer in Example 1 was performed as described below. In addition, the electrophotographic photosensitive member 2 was evaluated in the same manner as in Example 1.

Preparation of Coating Liquid for Intermediate Layer 25 parts of N-methoxymethylated nylon 6 (trade name: Toresin EF-30T, manufactured by Nagase ChemteX Corporation, methoxymethylation ratio: 36.8%) was dissolved in 225 parts of n-butanol (dissolution by heating at 50° C.). After the dissolution, the solution was cooled and filtrated with a membrane filter (trade name: FP-022, pore size: 0.22 μm, manufactured by Sumitomo Electric Industries, Ltd.). Next, 2.4 parts of an acidic titania sol (acidic sol) containing anatase-type titanium oxide crystal particles having an average primary particle diameter of 6 nm (trade name: TKS-201, hydrochloric acid sol, titanium oxide content: 33 mass %, manufactured by TAYCA) and 15 parts of surface-untreated, rutile-type titanium oxide crystal particles having an average primary particle diameter of 15 nm (trade name: MT-150A, manufactured by TAYCA) were added to the filtrate. The mixture was placed in a sand mill apparatus using 500 parts of glass beads having an average diameter of 0.8 mm, and was subjected to dispersion treatment at 1,500 rpm for 7 hours.

After the dispersion treatment, the glass beads were separated by mesh filtration, and the separated liquid was diluted with methanol and n-butanol so that a solid content was 4.0% and a solvent ratio between methanol and n-butanol was 2:1. Thus, a coating liquid for an intermediate layer was prepared.

The content of anatase-type titanium oxide crystal particles having an average primary particle diameter of 3 nm or more and 9 nm or less in the acidic titania sol in the coating liquid for an intermediate layer was 1.9 mass % with respect to the total mass of the dry solid matter in the coating liquid for an intermediate layer.

Comparative Example 2

An electrophotographic photosensitive member C2 was produced in the same manner as in Example 2 except that the acidic titania sol (trade name: TKS-201) was not added to the coating liquid for an intermediate layer in Example 2. In addition, the electrophotographic photosensitive member C2 was evaluated in the same manner as in Example 1.

Example 3

An electrophotographic photosensitive member 3 was produced in the same manner as in Example 2 except that the titanium oxide particles (trade name: MT-150A) used in the coating liquid for an intermediate layer in Example 2 were changed to surface-untreated, anatase-type titanium oxide crystal particles having an average primary particle diameter of 15 nm (trade name: TKP-102, manufactured by TAYCA). In addition, the electrophotographic photosensitive member 3 was evaluated in the same manner as in Example 1.

Example 4

An electrophotographic photosensitive member 4 was produced in the same manner as in Example 1 except that the amount of the acidic titania sol (trade name: TKS-201) used in the coating liquid for an intermediate layer in Example 1 was changed from 2.4 parts to 12 parts. In addition, the electrophotographic photosensitive member 4 was evaluated in the same manner as in Example 1.

The content of anatase-type titanium oxide crystal particles having an average primary particle diameter of 3 nm or more and 9 nm or less in the acidic titania sol in the coating liquid for an intermediate layer was 13.7 mass % with respect to the total mass of the dry solid matter in the coating liquid for an intermediate layer.

Example 5

An electrophotographic photosensitive member 5 was produced in the same manner as in Example 1 except that the amount of the acidic titania sol (trade name: TKS-201) used in the coating liquid for an intermediate layer in Example 1 was changed from 2.4 parts to 4.8 parts. In addition, the electrophotographic photosensitive member 5 was evaluated in the same manner as in Example 1.

The content of anatase-type titanium oxide crystal particles having an average primary particle diameter of 3 nm or more and 9 nm or less in the acidic titania sol in the coating liquid for an intermediate layer was 6.0 mass % with respect to the total mass of the dry solid matter in the coating liquid for an intermediate layer.

Example 6

An electrophotographic photosensitive member 6 was produced in the same manner as in Example 1 except that the acidic titania sol (trade name: TKS-201) used in the coating liquid for an intermediate layer in Example 1 was changed to an acidic titania sol containing anatase-type titanium oxide crystal particles having an average primary particle diameter of 6 nm (trade name: TKS-202, nitric acid sol, titanium oxide content: 33 mass %, manufactured by TAYCA). In addition, the electrophotographic photosensitive member 6 was evaluated in the same manner as in Example 1.

Example 7

An electrophotographic photosensitive member 7 was produced in the same manner as in Example 1 except that the drying after the coating of the coating liquid for an intermediate layer by immersion in Example 1 was changed from drying for 10 minutes at 100° C. to drying for 10 minutes at 145° C. In addition, the electrophotographic photosensitive member 7 was evaluated in the same manner as in Example 1.

Example 8

An electrophotographic photosensitive member 8 was produced in the same manner as in Example 1 except that the preparation of a coating liquid for an intermediate layer in Example 1 was performed as described below. In addition, the electrophotographic photosensitive member 8 was evaluated in the same manner as in Example 1.

Preparation of Coating Liquid for Intermediate Layer 20 parts of N-methoxymethylated nylon 6 (trade name: Toresin EF-30T, manufactured by Nagase ChemteX Corporation, methoxymethylation ratio: 36.8%) were dissolved in 180 parts of n-butanol (dissolution by heating at 65° C.). After the dissolution, the solution was cooled and filtrated with a membrane filter (trade name: FP-022, pore size: 0.22 μm, manufactured by Sumitomo Electric Industries, Ltd.). Next, the filtrate was left to stand in a sealed container at room temperature for 5 days, whereby a gelled polyamide resin solution was obtained.

1.7 parts of an acidic titania sol (acidic sol) containing anatase-type titanium oxide crystal particles having an average primary particle diameter of 6 nm (trade name: TKS-201, manufactured by TAYCA), 10.1 parts of surface-untreated, rutile-type titanium oxide crystal particles having an average primary particle diameter of 15 nm (trade name: MT-150A, manufactured by TAYCA), 5.3 parts of Exemplified Compound (2-1), and 30 parts of ethanol were added to the polyamide resin solution. The mixture was place in a sand mill apparatus using 506 parts of glass beads having an average diameter of 0.8 mm, and was subjected to a dispersion treatment at 1,500 rpm for 7 hours.

After the dispersion treatment, the glass beads were separated by mesh filtration, and the separated liquid was diluted with ethanol and n-butanol so that a solid content was 4.8% and the solvent ratio between ethanol and n-butanol was 2:1. Thus, a coating liquid for an intermediate layer was prepared.

The content of anatase-type titanium oxide crystal particles having an average primary particle diameter of 3 nm or more and 9 nm or less in the acidic titania sol in the coating liquid for an intermediate layer was 1.6 mass % with respect to the total mass of the dry solid matter in the coating liquid for an intermediate layer.

Comparative Example 3

An electrophotographic photosensitive member C3 was produced in the same manner as in Example 8 except that the acidic titania sol (trade name: TKS-201) was not added to the coating liquid for an intermediate layer in Example 8. In addition, the electrophotographic photosensitive member C3 was evaluated in the same manner as in Example 1.

Comparative Example 4

An electrophotographic photosensitive member C4 was produced in the same manner as in Example 8 except that the acidic titania sol (trade name: TKS-201) and titanium oxide particles (trade name: MT-150A) were not added to the coating liquid for an intermediate layer in Example 8. In addition, the electrophotographic photosensitive member C4 was evaluated in the same manner as in Example 1.

Example 9

An electrophotographic photosensitive member 9 was produced in the same manner as in Example 1 except that the amount of the acidic titania sol (trade name: TKS-201) used in the coating liquid for an intermediate layer in Example 8 was changed from 1.7 parts to 1.2 parts. In addition, the electrophotographic photosensitive member 9 was evaluated in the same manner as in Example 1.

The content of anatase-type titanium oxide crystal particles having an average primary particle diameter of 3 nm or more and 9 nm or less in the acidic titania sol in the coating liquid for an intermediate layer was 1.1 mass % with respect to the total mass of the dry solid matter in the coating liquid for an intermediate layer.

Example 10

An electrophotographic photosensitive member 10 was produced in the same manner as in Example 8 except that the titanium oxide particles (trade name: MT-150A) used in the coating liquid for an intermediate layer in Example 8 were changed to surface-untreated, rutile-type titanium oxide crystal particles having an average primary particle diameter of 35 nm (trade name: MT-500B, manufactured by TAYCA). In addition, the electrophotographic photosensitive member 10 was evaluated in the same manner as in Example 1.

Example 11

An electrophotographic photosensitive member 11 was produced in the same manner as in Example 8 except that the titanium oxide particles (trade name: MT-150A) used in the coating liquid for an intermediate layer in Example 8 were changed to surface-untreated, rutile-type titanium oxide crystal particles having an average primary particle diameter of 50 nm (trade name: MT-600B, manufactured by TAYCA). In addition, the electrophotographic photosensitive member 11 was evaluated in the same manner as in Example 1.

Example 12

An electrophotographic photosensitive member 12 was produced in the same manner as in Example 8 except that the acidic titania sol (trade name: TKS-201) used in the coating liquid for an intermediate layer in Example 8 were changed to an acidic titania sol (acidic sol) containing anatase-type titanium oxide crystal particles having an average primary particle diameter of 6 nm (trade name: TKS-202, nitric acid sol, titanium oxide content: 33 mass %, manufactured by TAYCA). In addition, the electrophotographic photosensitive member 12 was evaluated in the same manner as in Example 1.

Example 13

An electrophotographic photosensitive member 13 was produced in the same manner as in Example 8 except that the titanium oxide particles (trade name: MT-150A) used in the coating liquid for an intermediate layer in Example 8 were changed to surface-untreated, anatase-type titanium oxide crystal particles having an average primary particle diameter of 15 nm (trade name: TKP-102, manufactured by TAYCA). In addition, the electrophotographic photosensitive member 13 was evaluated in the same manner as in Example 1.

Example 14

An electrophotographic photosensitive member 14 was produced in the same manner as in Example 8 except that the thickness of the intermediate layer in Example 8 was changed from 0.45 μm to 0.65 μm. In addition, the electrophotographic photosensitive member 14 was evaluated in the same manner as in Example 1.

Example 15

An electrophotographic photosensitive member 15 was produced in the same manner as in Example 1 except that 2.4 parts of the acidic titania sol (trade name: TKS-201) used in the coating liquid for an intermediate layer in Example 1 was changed to 2.7 parts of an acidic titania sol (acidic sol) containing anatase-type titanium oxide crystal particles having an average primary particle diameter of 7 nm (trade name: STS-01, nitric acid sol, titanium oxide content: 30 mass %, manufactured by ISHIHARA SANGYO KAISHA, LTD.). In addition, the electrophotographic photosensitive member 15 was evaluated in the same manner as in Example 1.

Example 16

An electrophotographic photosensitive member 16 was produced in the same manner as in Example 1 except that 2.4 parts of the acidic titania sol (trade name: TKS-201) used in the coating liquid for an intermediate layer in Example 1 was changed to 2.7 parts of an acidic titania sol (acidic sol) containing anatase-type titanium oxide crystal particles having an average primary particle diameter of 7 nm (trade name: STS-02, hydrochloric acid sol, titanium oxide content: 30 mass %, manufactured by ISHIHARA SANGYO KAISHA, LTD.). In addition, the electrophotographic photosensitive member 16 was evaluated in the same manner as in Example 1.

Example 17

An electrophotographic photosensitive member 17 was produced in the same manner as in Example 1 except that 2.4 parts of the acidic titania sol (trade name: TKS-201) used in the coating liquid for an intermediate layer in Example 1 was changed to 4.0 parts of an acidic titania sol (acidic sol) containing anatase-type titanium oxide crystal particles having an average primary particle diameter of 5 nm (trade name: STS-100, nitric acid sol, titanium oxide content: 20 mass %, manufactured by ISHIHARA SANGYO KAISHA, LTD.). In addition, the electrophotographic photosensitive member 17 was evaluated in the same manner as in Example 1.

TABLE 1

| | Electrophotographic photosensitive member | ΔV1 (initial) [V] | ΔV1 (after 5 minutes) [V] | ΔV1 (next day) [V] | ΔV1 (after 1 week) [V] | ΔV1 (long-term variation) [V] |
|---|---|---|---|---|---|---|
| Example 1 | Electrophotographic photosensitive member 1 | +2 | +18 | +14 | +8 | +23 |

TABLE 1-continued

| | Electrophotographic photosensitive member | ΔV1 (initial) [V] | ΔV1 (after 5 minutes) [V] | ΔV1 (next day) [V] | ΔV1 (after 1 week) [V] | ΔV1 (long-term variation) [V] |
|---|---|---|---|---|---|---|
| Example 2 | Electrophotographic photosensitive member 2 | ±0 | +15 | +12 | +8 | +12 |
| Example 3 | Electrophotographic photosensitive member 3 | +5 | +17 | +17 | +12 | +17 |
| Example 4 | Electrophotographic photosensitive member 4 | +8 | +22 | +18 | +12 | +20 |
| Example 5 | Electrophotographic photosensitive member 5 | +4 | +15 | +16 | +10 | +25 |
| Example 6 | Electrophotographic photosensitive member 6 | −2 | +20 | +14 | +9 | +21 |
| Example 7 | Electrophotographic photosensitive member 7 | +3 | +15 | +12 | +8 | +17 |
| Example 8 | Electrophotographic photosensitive member 8 | +4 | +15 | +11 | +8 | ±0 |
| Example 9 | Electrophotographic photosensitive member 9 | +7 | +17 | +15 | +15 | +10 |
| Example 10 | Electrophotographic photosensitive member 10 | +4 | +15 | +12 | +7 | ±0 |
| Example 11 | Electrophotographic photosensitive member 11 | +3 | +17 | +13 | +10 | +3 |
| Example 12 | Electrophotographic photosensitive member 12 | +4 | +14 | +10 | +10 | +3 |
| Example 13 | Electrophotographic photosensitive member 13 | +2 | +10 | +7 | +6 | +13 |
| Example 14 | Electrophotographic photosensitive member 14 | +6 | +17 | +12 | +12 | +2 |
| Example 15 | Electrophotographic photosensitive member 15 | ±0 | +20 | +15 | +10 | +21 |
| Example 16 | Electrophotographic photosensitive member 16 | +3 | +19 | +15 | +9 | +23 |
| Example 17 | Electrophotographic photosensitive member 17 | −4 | +18 | +10 | +6 | +19 |
| Comparative Example 1 | Electrophotographic photosensitive member C1 | +10 | +24 | +24 | +27 | +35 |
| Comparative Example 2 | Electrophotographic photosensitive member C2 | +20 | +24 | +22 | +24 | +30 |
| Comparative Example 3 | Electrophotographic photosensitive member C3 | +12 | +23 | +26 | +18 | +28 |
| Comparative Example 4 | Electrophotographic photosensitive member C4 | +6 | +14 | +17 | +20 | +33 |

As can be seen from the results shown in Table 1, the electrophotographic photosensitive member 1 of Example 1 having an intermediate layer formed by using the acidic titania sol according to the present invention shows good results concerning a potential variation as compared to the electrophotographic photosensitive member C1 of Comparative Example 1 having an intermediate layer formed without using the acidic titania sol according to the present invention.

In addition, the electrophotographic photosensitive member C2 of Comparative Example 2 having an intermediate layer formed by using not the acidic titania sol according to the present invention but only the titanium oxide particles having an average primary particle diameter of 15 nm does not show good results concerning a potential variation. Therefore, it is understandable that a potential variation cannot be sufficiently suppressed merely by incorporating titanium oxide particles having a small particle diameter into the intermediate layer.

That is, the intermediate layer must be a layer formed by using the acidic titania sol according to the present invention in order that a potential variation within a short time period which becomes remarkable when image formation is performed under a low-humidity environment and a potential variation over a long time period can be suppressed.

In addition, the results of Example 2 show that results concerning a potential variation become better when both the acidic titania sol according to the present invention and surface-untreated titanium oxide particles having an average primary particle diameter of 13 nm or more and 60 nm or less are incorporated into the intermediate layer.

Furthermore, the results of Example 8 show that results concerning a potential variation become better when an azo pigment is incorporated into the intermediate layer.

This application claims the priority of Japanese Patent Application No. 2007-313574, filed Dec. 4, 2007, which is hereby incorporated by reference herein in its entirety.

What is claimed is:

1. An electrophotographic photosensitive member, comprising:

a support;

an intermediate layer formed on the support;

a charge-generating layer containing an organic photoconductive substance as a charge-generating substance and a binder resin, formed on the intermediate layer; and a hole-transporting layer containing a hole-transporting substance, formed on the charge-generating layer, wherein:

the intermediate layer is a layer formed by coating and drying a coating liquid for an intermediate layer, containing an acidic titania sol and an organic resin; and the acidic titania sol comprises an acidic sol containing anatase-type titanium oxide crystal particles having an average primary particle diameter of 3 nm or more and 9 nm or less.

2. An electrophotographic photosensitive member according to claim 1, wherein the coating liquid for an intermediate layer further contains surface-untreated titanium oxide particles having an average primary particle diameter of 13 nm or more and 60 nm or less.

3. An electrophotographic photosensitive member according to claim 1, wherein the acidic titania sol comprises a hydrochloric acid sol or a nitric acid sol.

4. An electrophotographic photosensitive member according to claim 1, wherein the organic resin comprises a polyamide.

5. An electrophotographic photosensitive member according to claim 4, wherein the polyamide comprises methoxymethylated nylon 6.

6. An electrophotographic photosensitive member according to claim 1, wherein a content of the anatase-type titanium oxide crystal particles having an average primary particle diameter of 3 nm or more and 9 nm or less in the intermediate layer is 1.0 mass % or more and 10 mass % or less with respect to the total mass of the intermediate layer.

7. An electrophotographic photosensitive member according to claim 1, wherein the intermediate layer has a thickness of 0.3 μm or more and 1.5 μm or less.

8. An electrophotographic photosensitive member according to claim 1, which further has a layer containing inorganic particles between the support and the intermediate layer.

9. A method of producing an electrophotographic photosensitive member, comprising:

forming an intermediate layer on a support;

forming a charge-generating layer containing an organic photoconductive substance as a charge-generating substance and a binder resin on the intermediate layer; and forming a hole-transporting layer containing a hole-transporting substance on the charge-generating layer, wherein:

formation of the intermediate layer comprises formation of the intermediate layer by coating and drying of a coating liquid for an intermediate layer, containing an acidic titania sol and an organic resin; and the acidic titania sol comprises an acidic sol containing anatase-type titanium oxide crystal particles having an average primary particle diameter of 3 nm or more and 9 nm or less.

10. A method of producing the electrophotographic photosensitive member according to claim 9, wherein the coating liquid for an intermediate layer further contains surface-untreated titanium oxide particles having an average primary particle diameter of 13 nm or more and 60 nm or less.

11. A method of producing the electrophotographic photosensitive member according to claim 9, wherein the acidic titania sol comprises a hydrochloric acid sol or a nitric acid sol.

12. A method of producing the electrophotographic photosensitive member according to claim 9, wherein the organic resin comprises a polyamide.

13. A method of producing the electrophotographic photosensitive member according to claim 12, wherein the polyamide comprises methoxymethylated nylon 6.

14. A method of producing an electrophotographic photosensitive member according to claim 9, wherein a drying temperature at which the coating liquid for an intermediate layer coated is dried, is 140° C. or higher and 155° C. or lower.

15. A process cartridge, which integrally holds:

the electrophotographic photosensitive member according to claim 1; and at least one unit selected from the group consisting of:

a charging unit for charging the surface of the electrophotographic photosensitive member;

a developing unit for developing an electrostatic latent image formed on the surface of the electrophotographic photosensitive member with toner to form a toner image on the surface of the electrophotographic photosensitive member; and a cleaning unit for removing the toner remaining on the surface of the electrophotographic photosensitive member after the toner image has been transferred onto a transfer material, and is detachably mountable on a main body of an electrophotographic apparatus.

16. An electrophotographic apparatus, comprising:

the electrophotographic photosensitive member according to claim 1;

a charging unit for charging a surface of the electrophotographic photosensitive member;

an exposing unit for irradiating the charged surface of the electrophotographic photosensitive member with exposure light to form an electrostatic latent image on the surface of the electrophotographic photosensitive member;

a developing unit for developing the electrostatic latent image formed on the surface of the electrophotographic photosensitive member with toner to form a toner image on the surface of the electrophotographic photosensitive member; and a transferring unit for transferring the toner image formed on the surface of the electrophotographic photosensitive member onto a transfer material.

17. An electrophotographic apparatus according to claim 16, wherein the electrophotographic photosensitive member has a cycle time of 0.4 sec or less/rotation.

* * * * *